US006901613B1

(12) United States Patent
Hsia

(10) Patent No.: US 6,901,613 B1
(45) Date of Patent: Jun. 7, 2005

(54) DUAL-USE PLAYPEN

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 0 days.

(21) Appl. No.: 10/793,147

(22) Filed: Mar. 4, 2004

(51) Int. Cl.[7] ..... A47D 13/06; A47D 7/00
(52) U.S. Cl. ..... 5/93.1; 5/98.1
(58) Field of Search ..... 5/93.1, 98.1, 655, 5/691, 922

(56) References Cited

U.S. PATENT DOCUMENTS 1,960,474 A * 5/1934 Browne ..... 441/129
3,089,153 A * 5/1963 Bosc ..... 5/710
5,279,237 A * 1/1994 Alivizatos ..... 112/475.05
5,813,066 A * 9/1998 Gebhard et al. ..... 5/655
5,822,817 A * 10/1998 Carew et al. ..... 5/732
5,937,465 A * 8/1999 Carew et al. ..... 5/732
2004/0187207 A1 * 9/2004 Hsia ..... 5/93.1

* cited by examiner

*Primary Examiner*—Robert G. Santos
(74) *Attorney, Agent, or Firm*—Christie, Parker & Hale, LLP

(57) ABSTRACT

A dual-use playpen includes a hollow body, a separating member, and a frame member. The hollow body has first and second open ends opposite to each other. The separating member is mounted in the hollow body between the first and second open ends so as to partition the hollow body into a first region having a first depth, and a second region having a second depth smaller than the first depth. The frame member includes a first frame portion framing the first open end, a second frame portion framing the second open end, and a plurality of connecting rods extending and connected between the first and second frame portions.

6 Claims, 7 Drawing Sheets

DUAL-USE PLAYPEN

BACKGROUND OF THE INVENTION

1. Field of the Invention

The invention relates to a playpen, more particularly to a dual-use playpen.

2. Description of the Related Art

Referring to FIG. 1, a conventional playpen 1 is configured with a playing region having a depth sufficient to prevent an infant playing in the region from climbing out of the playpen 1. Since the playing region is deep, it is not convenient for parents to change a diaper of the infant or to cover the infant with a blanket when the latter sleeps in the playing region of the playpen 1. Therefore, a suspending bed 2 is designed for installation in the playpen 1. When the infant is placed on the suspending bed 2, changing of the infant's diaper and covering the infant with a blanket are facilitated. However, the following drawbacks arise when the suspending bed 2 is in use:

1. The suspending bed 2 is required to be installed and disassembled frequently depending on the intended use of the playpen 1.
2. Extra space is required for storing the suspending bed 2 when the latter is disassembled from the playpen 1.
3. In order to fasten the suspending bed 2 on the playpen 1 securely, an additional fastening member is required, which in turn results in higher costs.

SUMMARY OF THE INVENTION

Therefore, the object of the present invention is to provide a dual-use playpen that can overcome the aforesaid drawbacks of the prior art.

Accordingly, the dual-use playpen of this invention includes a hollow body, a separating member, and a frame member. The hollow body is made of a flexible sheet material, and has a first open end and a second open end opposite to the first open end. The separating member is mounted in the hollow body between the first and second open ends so as to partition the hollow body into a first region having a first depth from the first open end, and a second region having a second depth from the second open end. The second depth is smaller than the first depth of the first region. The frame member supports the hollow body, and includes a first frame portion framing the first open end, a second frame portion framing the second open end, and a plurality of connecting rods extending and connected between the first and second frame portions. The dual-use playpen can be configured in one of a first state in which the first region is located above the second region such that an infant can play within the first region, and a second state in which the second region is located above the first region such that the infant can lie down in the second region.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
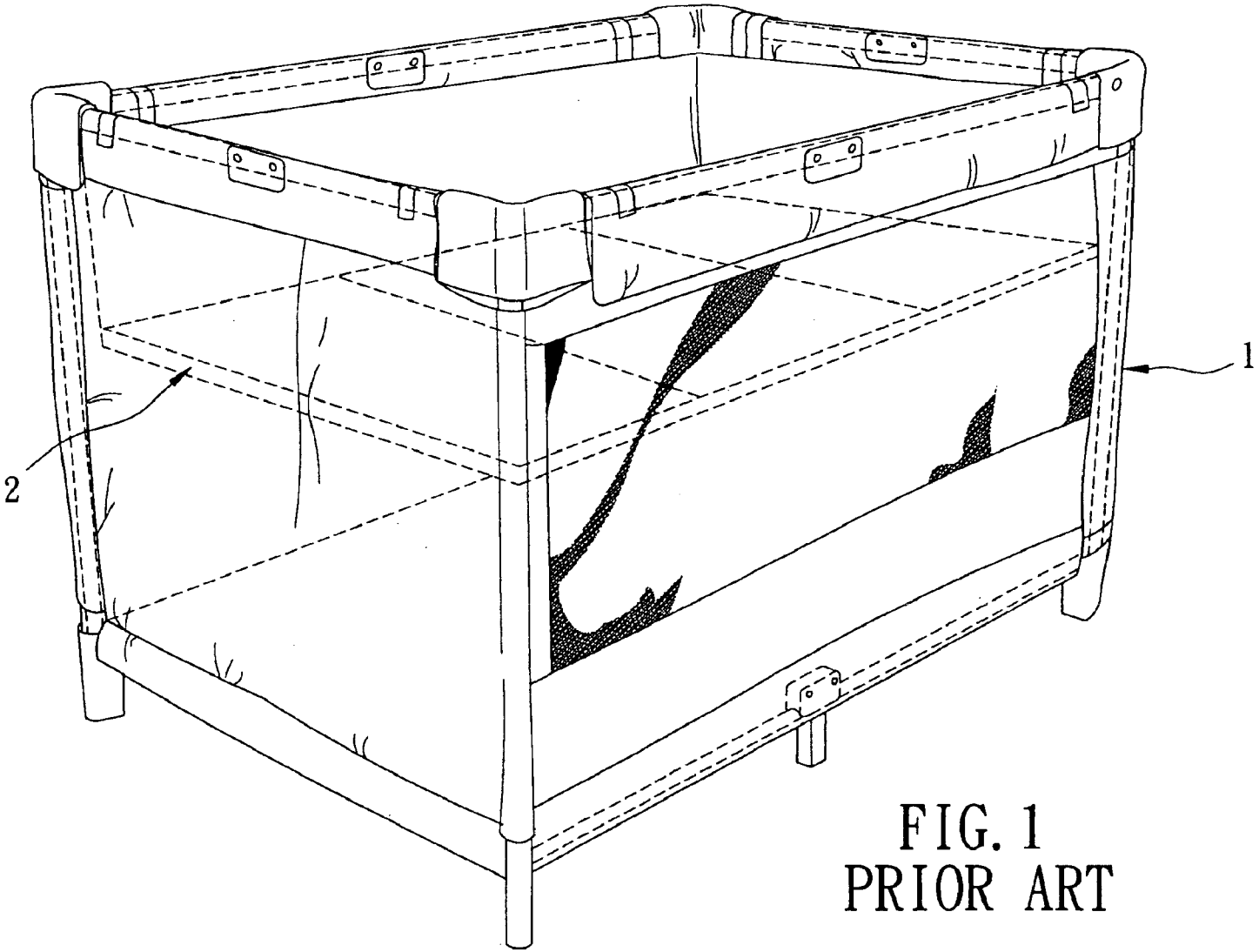
FIG. 1 PRIOR ART
FIG. 1 is a perspective view of a conventional playpen.
Figure 2:
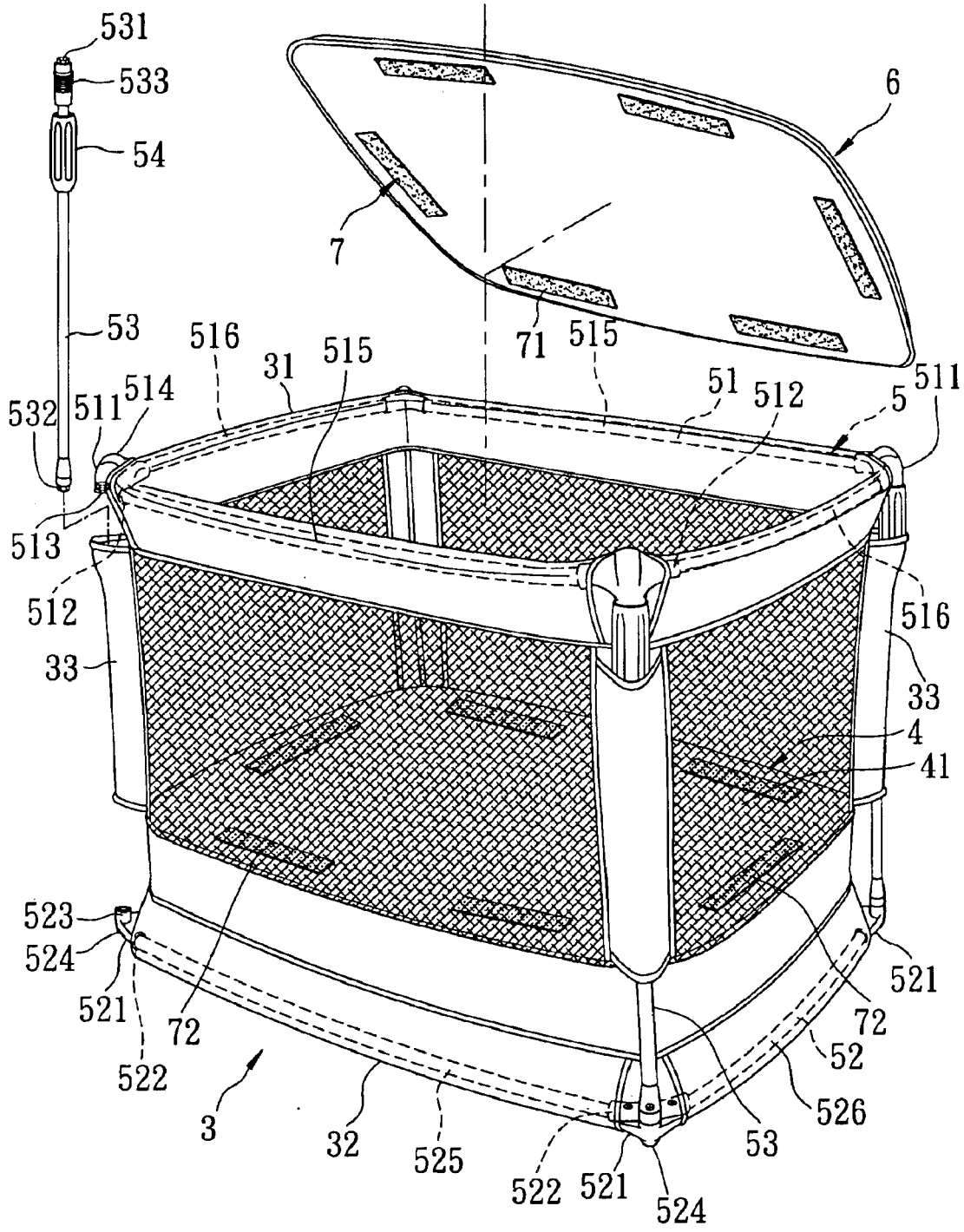
FIG. 2 is a partly exploded perspective view of the preferred embodiment of a dual-use playpen according to this invention.
Figure 3:
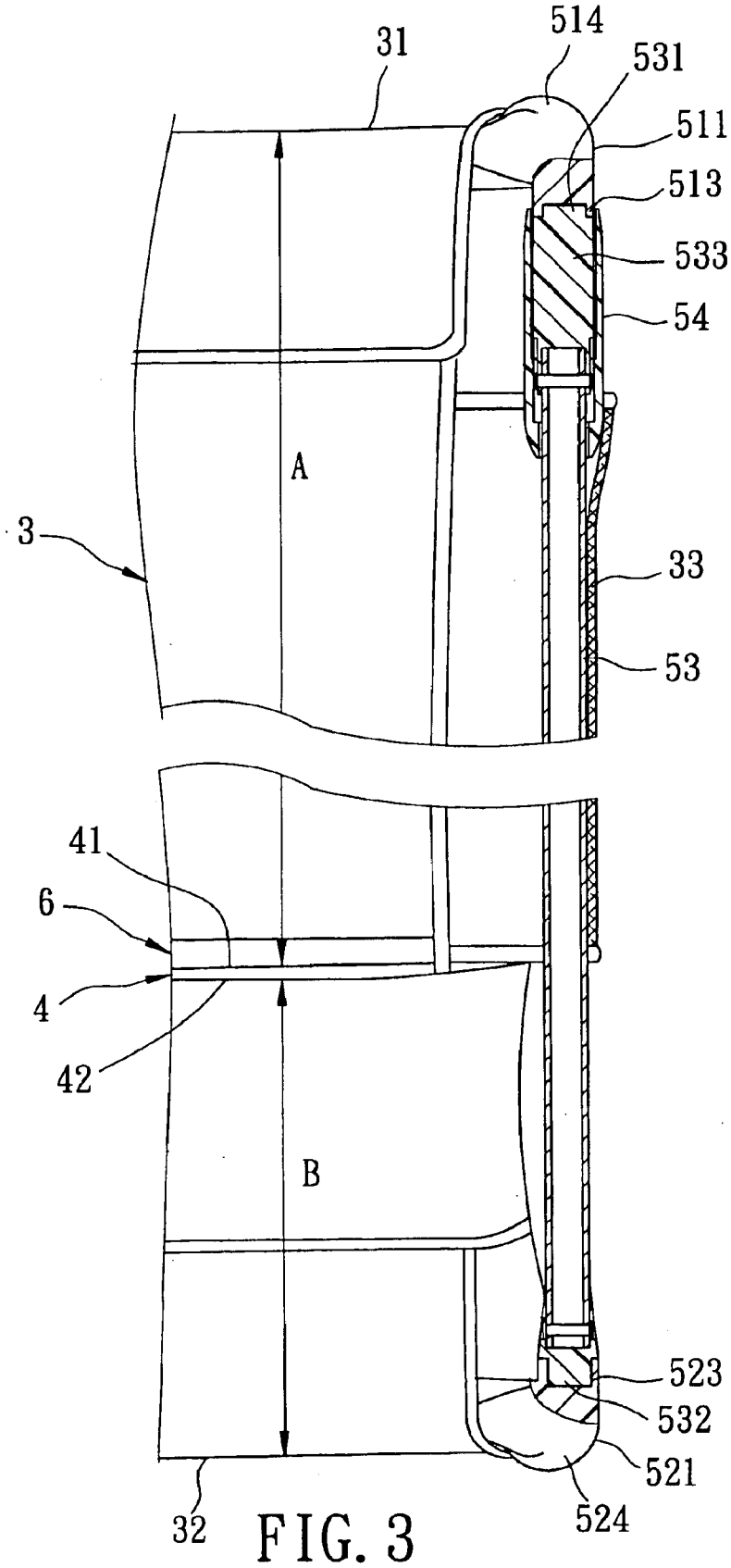
FIG. 3 is a fragmentary schematic sectional view of the preferred embodiment.

Referring to FIGS. 2 and 3, the preferred embodiment of a dual-use playpen according to this invention is shown to include a hollow body 3, a separating member 4, a frame member 5, a mattress 6, and a plurality of fastening members 7.

The hollow body 3 is made of a flexible sheet material, and has a first open end 31 and a second open end 32 opposite to the first open end 31. The hollow body 3 further includes a plurality of sleeves 33 extending between the first and second open ends 31,32.

The separating member 4 is mounted in the hollow body 3 between the first and second open ends 31,32 so as to partition the hollow body 3 into a first region (A) having a first depth from the first open end 31, and a second region (B) having a second depth from the second open end 32. The second depth is smaller than the first depth of the first region (A). In this embodiment, the separating member 4 is sewn to the hollow body 3 to form a unitary body. Furthermore, the separating member 4 has a first surface 41 facing toward the first region (A), and a second surface 42 facing toward the second region (B).

The frame member 5 supports the hollow body 3, and includes a first frame portion 51 framing the first open end 31, a second frame portion 52 framing the second open end 32, and a plurality of connecting rods 53 extending and connected between the first and second frame portions 51,52. Each of the first and second frame portions 51,52 includes two opposite horizontal first rods 515 (525), two opposite horizontal second rods 516 (526) extending between the two horizontal first rods 515 (525), and four corner blocks 511 (521) each having a vertical coupling portion 513 (523) connected to a corresponding one of the connecting rods 53, a foot 514 (524) opposite to the vertical coupling portion 513 (523), and two lateral coupling portions 512 (522) protruding laterally from the vertical coupling portion 513 (523) and connected to a corresponding one of the first rods 515 (525) and a corresponding one of the second rods 516 (526).

Each of the connecting rods 53 includes first and second ends 531,532 to mate with the vertical coupling portions 513,523 of the corresponding corner blocks 511,521, a male screw 533 proximate to the first end 531, and a sleeve 54 having a female screw. The sleeve 54 engages the male screw 533 and embraces a part of the vertical coupling portion 513 after the first end 531 mates with the vertical coupling portion 513.

The mattress 6 is mounted on either the first surface 41 or the second surface 42 of the separating member 4 according to the intended use of the playpen. Furthermore, each of the fastening members 7 includes a first fastening portion 71 mounted on an underside of the mattress 6, and a second fastening portion 72 mounted on the separating member 4 to engage releasably the first fastening portion 71. Preferably, both of the first and second surfaces 41,42 are mounted with the second fastening portions 72 of the fastening members 7.

During assembly, the connecting rods 53 are passed through the sleeves 33 respectively, and are then connected to the vertical coupling portions 513,523 of the corresponding corner blocks 511,521. Then, for each of the connecting rods 53, the sleeve 54 engages the male screw 533 and embraces a part of the vertical coupling portion 513 after the first end 531 mates with the vertical coupling portion 513. The hollow body 3 together with the separating member 4 is framed by the frame member 5 at this time.

Figure 4:
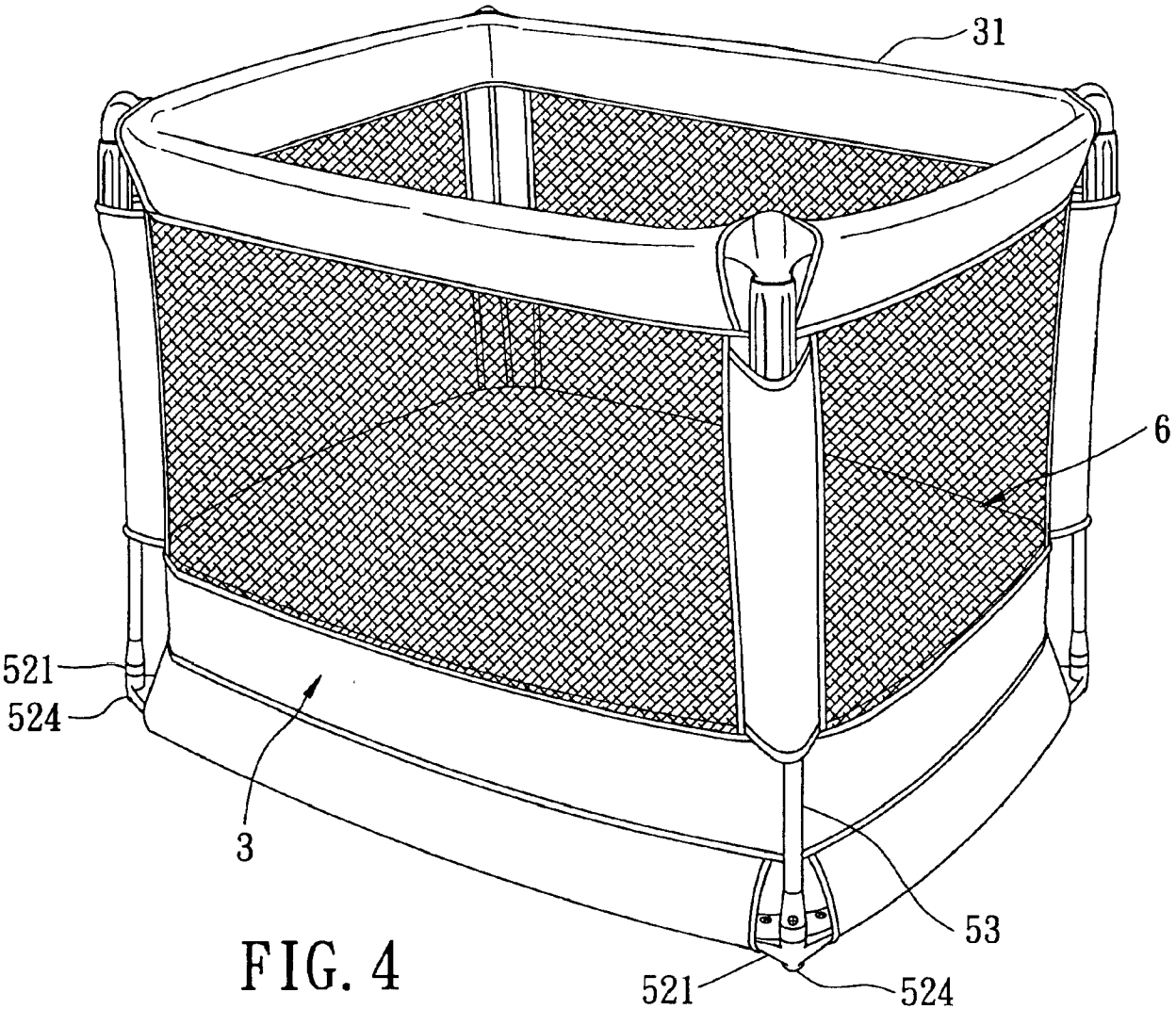
FIG. 4 is a perspective view of the preferred embodiment when configured with a playing region.
Figure 5:
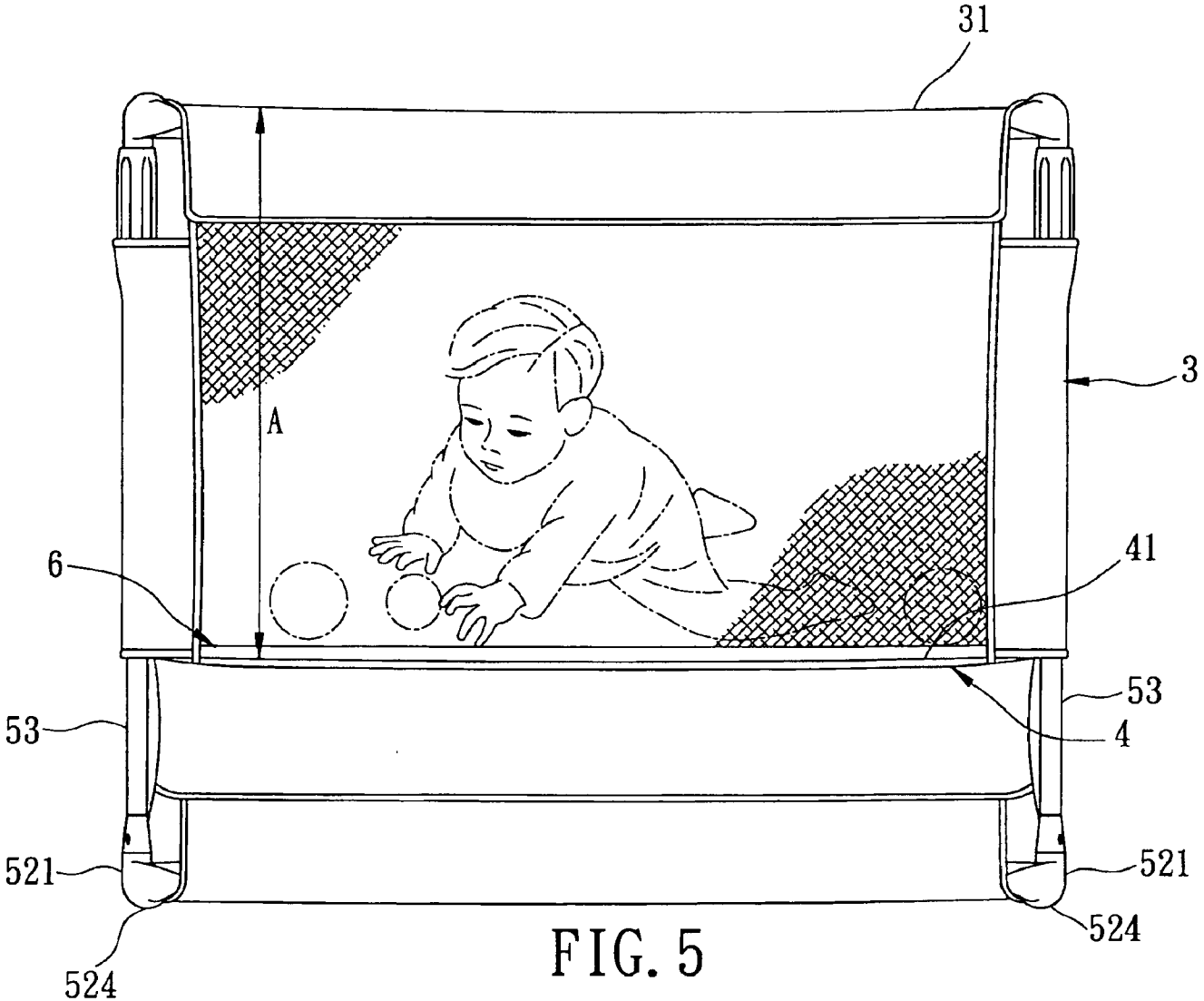
FIG. 5 is a schematic view of the preferred embodiment, showing a state in which an infant is playing in the playing region.

Referring to FIGS. 4 and 5, when it is intended for an infant to play in the playpen, the dual-use playpen is mounted in a first state in which the first region (A) is located above the second region (B). The mattress 6 can be mounted and fastened on the first surface 41 of the separating member 4 by fastening the first fastening portions 71 to the corresponding second fastening portions 72 of the fastening members 7.

Figure 6:
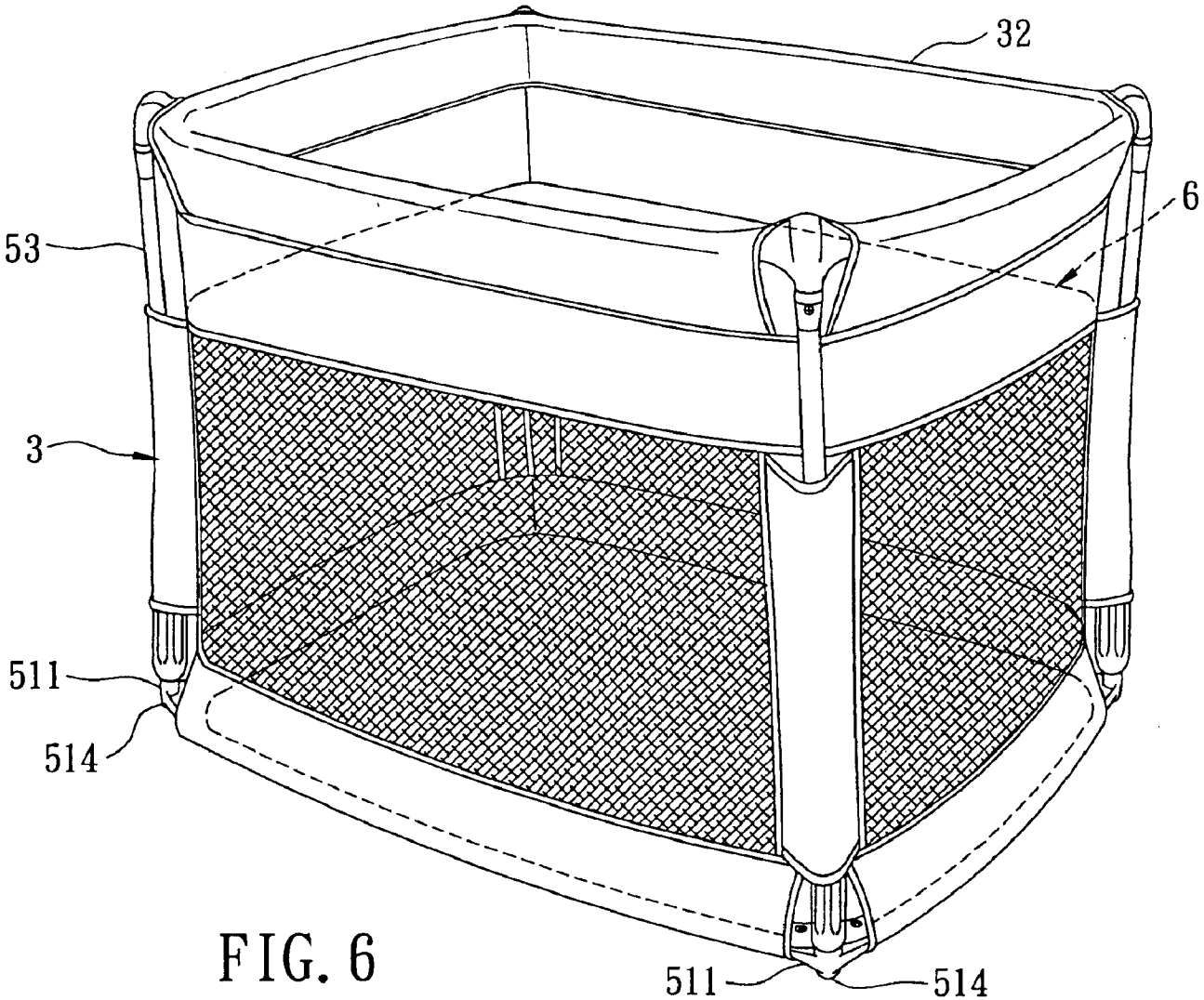
FIG. 6 is a perspective view of the preferred embodiment when configured with a resting region.
Figure 7:
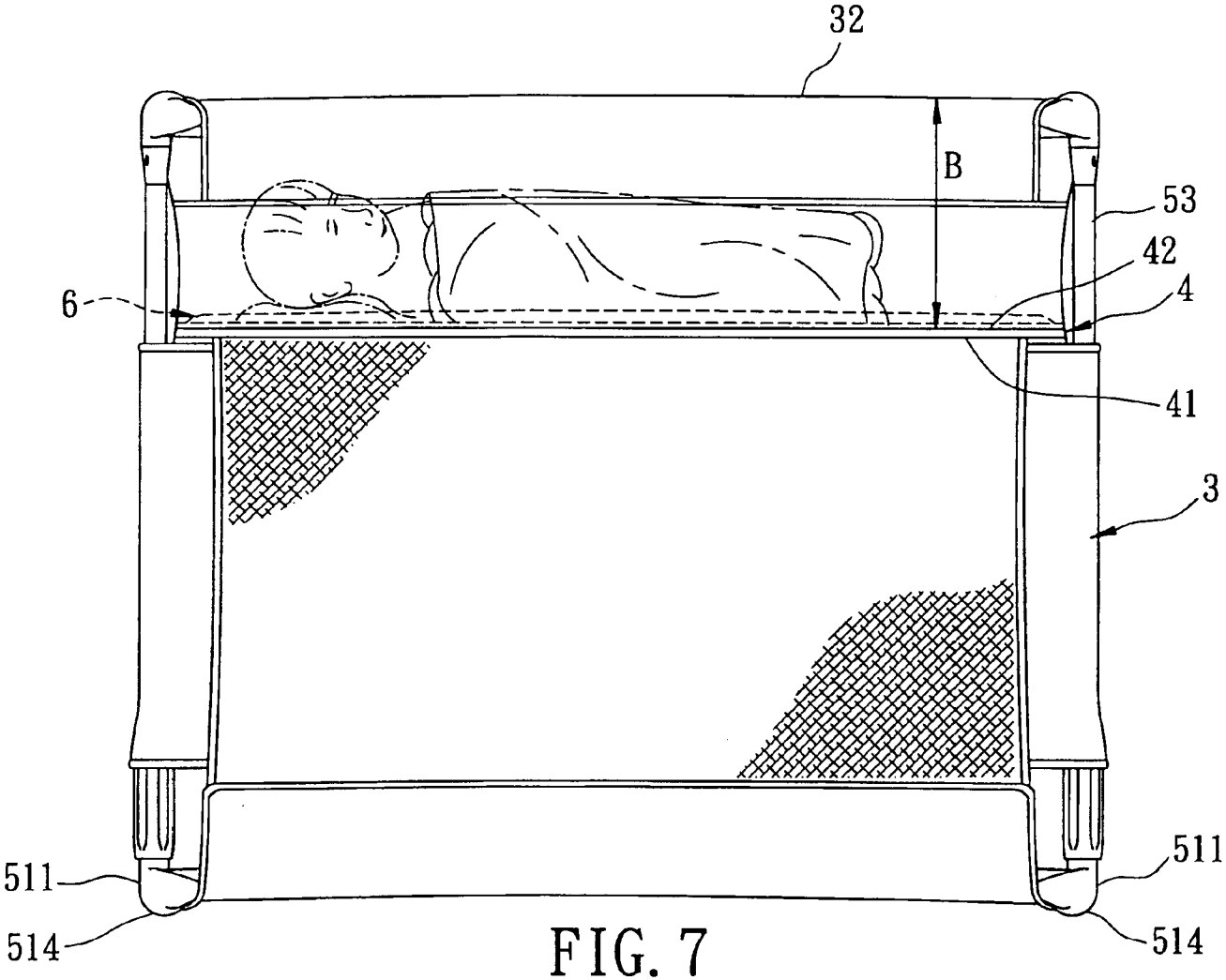
FIG. 7 is a schematic view of the preferred embodiment, showing a state in which the infant is placed in the resting region.

Referring to FIGS. 6 and 7, when it is intended to change a diaper of the infant or to put the infant to sleep, the mattress 6 is removed from the separating member 4, and the dual-use playpen is then upturned to a second state in which the second region (B) is located above the first region (A). The mattress 6 is then mounted and fastened on the second surface 42 of the separating member 4 by fastening the first fastening portions 71 to the corresponding second fastening portions 72 of the fastening members 7. The infant can rest in the second region (B) at this time.

In view of the aforesaid, since the playing and resting functions of the playpen can be accomplished easily by simply interchanging the orientations of the first region (A) and the second region (B) of the dual-use playpen of this invention, the aforesaid disadvantages of the prior art can be eliminated.

While the present invention has been described in connection with what is considered the most practical and preferred embodiment, it is understood that this invention is not limited to the disclosed embodiment but is intended to cover various arrangements included is within the spirit and scope of the broadest interpretation so as to encompass all such modifications and equivalent arrangements.

I claim:

1. A dual-use playpen comprising:

a hollow body made of a flexible sheet material, and having a first open end and a second open end opposite to said first open end;

a separating member mounted in said hollow body between said first and second open ends so as to partition said hollow body into a first region having a first depth from said first open end, and a second region having a second depth from said second open end, said second depth being smaller than said first depth of said first region; and a frame member for supporting said hollow body, and including a first frame portion framing said first open end, a second frame portion framing said second open end, and a plurality of connecting rods extending and connected between said first and second frame portions;

whereby said dual-use playpen can be configured in one of a first state in which said first region is located above said second region such that an infant can play within said first region, and a second state in which said second region is located above said first region such that the infant can lie down in said second region.

2. The dual-use playpen as claimed in claim 1, wherein said separating member is sewn to said hollow body to form a unitary body.

3. The dual-use playpen as claimed in claim 1, further comprising a mattress mounted on said separating member.

4. The dual-use playpen as claimed in claim 3, further comprising a plurality of fastening members, each of said fastening members including a first fastening portion mounted on an underside of said mattress, and a second fastening portion mounted on said separating member to engage releasably said first fastening portion.

5. The dual-use playpen as claimed in claim 1, wherein each of said first and second frame portions includes two opposite horizontal first rods, two opposite horizontal second rods extending between said two horizontal first rods, and four corner blocks each having a vertical coupling portion connected to a corresponding one of said connecting rods, a foot opposite to said vertical coupling portion, and two lateral coupling portions protruding laterally from said vertical coupling portion and connected to a corresponding one of said first rods and a corresponding one of said second rods.

6. The dual-use playpen as claimed in claim 5, wherein each of said connecting rods includes one end to mate with said vertical coupling portion of a corresponding one of said corner blocks, a male screw proximate to said one end, and a sleeve having a female screw, said sleeve engaging said male screw and embracing a part of said vertical coupling portion after said one end mates with said vertical coupling portion.

* * * * *